US006466083B1

(12) United States Patent
Barnes

(10) Patent No.: US 6,466,083 B1
(45) Date of Patent: Oct. 15, 2002

(54) CURRENT REFERENCE CIRCUIT WITH VOLTAGE OFFSET CIRCUITRY

(75) Inventor: William Bryan Barnes, Bristol (GB)

(73) Assignee: STMicroelectronics Limited, Almondsbury Bristol (GB)

( * ) Notice: Subject to any disclaimer, the term of this patent is extended or adjusted under 35 U.S.C. 154(b) by 0 days.

(21) Appl. No.: 09/642,344

(22) Filed: Aug. 21, 2000

(30) Foreign Application Priority Data

Aug. 24, 1999 (GB) ..... 9920081

(51) Int. Cl.[7] ..... G05F 1/10
(52) U.S. Cl. ..... 327/543; 327/540; 323/315
(58) Field of Search ..... 327/538, 540, 327/541, 543, 539; 323/313, 315

(56) References Cited

U.S. PATENT DOCUMENTS 5,047,706 A * 9/1991 Ishibashi et al. ..... 323/313
5,382,916 A * 1/1995 King et al. ..... 330/253
5,483,196 A * 1/1996 Ramet ..... 323/313
5,694,033 A 12/1997 Wei et al. ..... 323/315
5,783,936 A * 7/1998 Girard et al. ..... 323/315
5,818,292 A * 10/1998 Slemmer ..... 327/539
5,900,773 A * 5/1999 Susak ..... 327/539
5,955,874 A * 9/1999 Zhou et al. ..... 323/315
6,084,391 A * 7/2000 Onodera ..... 323/315
6,104,234 A * 8/2000 Shin et al. ..... 327/535

FOREIGN PATENT DOCUMENTS

EP 0 397 408 11/1990 ..... G05F/3/24
EP 0 778 509 6/1997 ..... G05F/3/26

* cited by examiner

*Primary Examiner*—Terry D. Cunningham
(74) *Attorney, Agent, or Firm*—Wolf, Greenfield & Sacks, P.C.; James H. Morris; Robert A. Skrivanek, Jr.

(57) ABSTRACT

An integrated current reference comprises two current mirrors, the gate source voltage of one of the current mirrors being offset by a voltage reference element, which in an embodiment consists of an on MOSFET.

11 Claims, 1 Drawing Sheet

CURRENT REFERENCE CIRCUIT WITH VOLTAGE OFFSET CIRCUITRY

FIELD OF THE INVENTION

The present invention relates to an integrated current reference circuit.

BACKGROUND TO THE INVENTION

It is known to provide a constant current generating circuit using two interconnected current mirrors, of which one current mirror is of p FETs and the other is of n FETs. Such circuits have traditionally required one of the branches of the current generator to contain a resistor.

Use of resistors in integrated circuits is not desirable for a number of reasons, for instance because of the temperature dependence thereof, because of the area occupied by a resistor and the difficulty of manufacture.

The present invention therefore aims to at least partly mitigate the difficulties of the prior art.

SUMMARY OF THE INVENTION

According to the present invention there is provided an integrated current reference circuit comprising a first current mirror and a second current mirror, the first current mirror having a first diode-connected transistor providing a controlling input and a first controlled transistor having a control electrode connected to that of the first diode-connected transistor, and the second current mirror having a second diode-connected transistor providing a controlling input and a second controlled transistor having a control electrode connected to that of the second diode connected transistor, the first diode-connected transistor and the second controlled transistor and the first controlled transistor and the second diode-connected transistor forming first and second serial branches disposed between a first supply rail and a second supply rail, wherein one of said branches comprises the series connection of voltage offset circuitry and a control transistor having a main current path, the voltage offset circuitry being connected between the control transistor main current path and one of said supply rails, and a control terminal of said control transistor being coupled to said one supply rail.

Preferably said first current mirror comprises p MOSFETs and the second current mirror comprises n MOSFETs.

Advantageously said second diode-connected transistor is large by comparison with said second controlled transistor.

Conveniently said control transistor is a p MOSFET having its control terminal coupled to the negative supply rail.

Advantageously the voltage offset circuitry comprises a diode.

Conveniently the diode comprises a diode-connected FET.

Conveniently both said first and second branches comprise voltage offset circuitry.

Preferably said circuit further comprises an output transistor having a control electrode connected to the control electrode of the first diode-connected transistor of the first current mirror.

BRIEF DESCRIPTION OF THE DRAWINGS

An embodiment of the present invention will be described, by way of example only, with reference to the accompanying drawings in which.

DESCRIPTION OF THE PREFERRED EMBODIMENT

Figure 1:
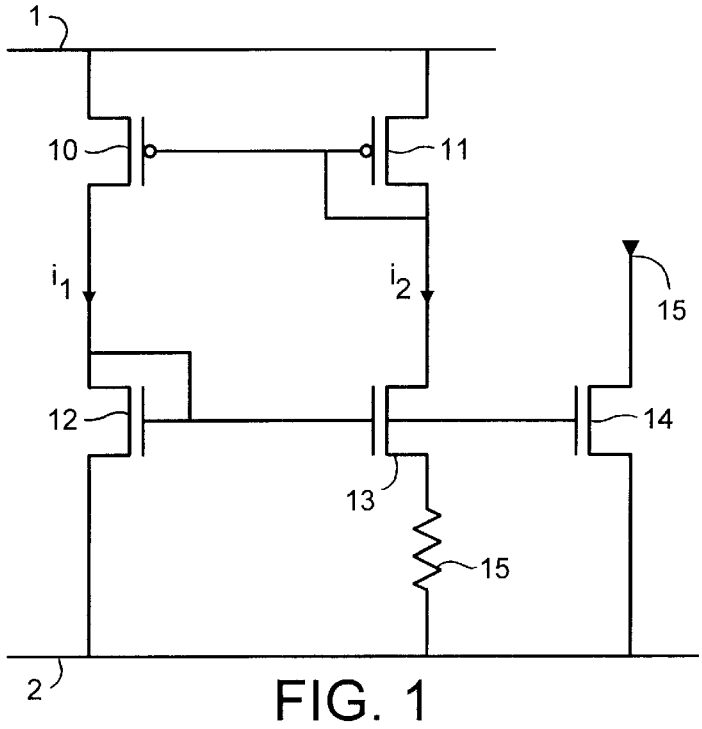
FIG. 1 shows a prior art constant current generating apparatus.

In the various figures like reference numerals refer to like parts.

Referring to FIG. 1, a current reference circuit according to the prior art consists of a first current mirror comprising a first p FET 11 having a gate connected in common with its drain and a source connected to a positive supply terminal 1, and a second p FET 10 having a source connected to the positive supply terminal 1 and a gate connected to the commoned gate/drain electrodes of the first transistor 11.

The circuit further comprises a second current mirror which consists of a first n FET 12 having a gate electrode connected in common with its drain electrode, and a source electrode connected to a negative supply terminal 2. The second current mirror has a second n FET 13 whose gate is connected to the commoned gate and drain electrodes of the first n FET 12. The source of the second n FET 13 of the second current mirror is connected via a resistor 15 to the negative supply terminal 2.

The gate electrode of the second n FET 13 is also connected to the gate electrode of an output transistor 14, which has a source electrode connected to the negative supply terminal 2, the drain 15 of the output transistor 14 providing a circuit output.

The commoned gate and drain electrodes of the first transistor 11 of the first current mirror constitutes a controlling node of that current mirror and the drain of the second transistor 10 of the first current mirror constitutes a controlled node of that current mirror. As is known to those skilled in the art, as the parameters of the transistors 10 and 11 are matched by virtue of their being formed on an integrated circuit, application of a current to the controlling node causes a corresponding current at the controlled node, depending on the relative sizes of the transistors.

Similarly, the commoned gate and drain electrodes of the first transistor 12 of the second current mirror constitutes a controlling node of the second current mirror whereas the drain of the second transistor 13 of the second current mirror constitutes the controlled node of that transistor.

Further reference to FIG. 1 shows that the controlled node of the first current mirror is connected to the controlling node of the second current mirror and the controlling node of the first current mirror is connected to the controlled node of the second current mirror.

In the arrangement described, the second transistor 13 of the second current mirror is "stronger" than the first transistor 12 of the second current mirror. It will be clear to those skilled in the art that the arrangement shown in FIG. 1 has in fact two stable operating conditions, namely one in which no current flows through either current mirror and a second state in which a non-zero current is sunk by the output terminal 15.

Considering the second stable state, with second n FET 13 having a conductivity which is n times that of the first n FET 12. Naming the current through the controlling transistor 11 of the first current mirror and the controlled transistor 13 of the second current mirror as I2, and the current through the controlled transistor 10 of the first current mirror and the controlling transistor 12 of the second current mirror as I1, the following arise:

The first current mirror constrains the two currents such that $$I1=I2.$$

The second current mirror constrains the two currents such that $$I2=n\times I1.$$

Clearly these two constraints alone cannot be satisfied. However, the source potential of the transistor 13 is increased by the current flow through the resistor 15. This reduces the gate-source potential, and thus the ability of transistor 13 to conduct current under the bias conditions provided by the transistor 12.

The result is that the two currents I1 and I2 reach an equilibrium condition at which the two currents become equal and independent of the voltage applied to the circuit.

Figure 2:
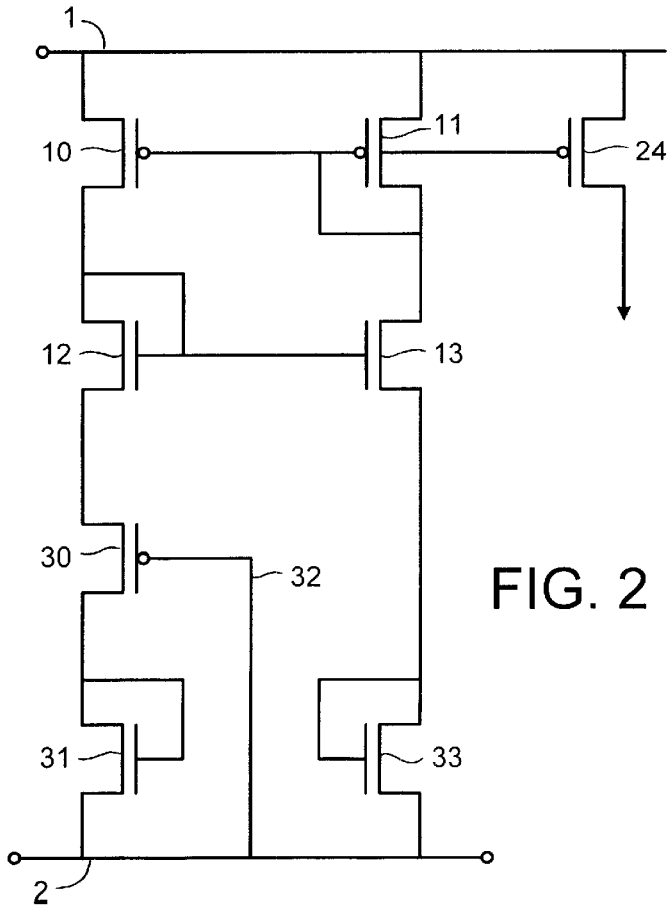
FIG. 2 shows an embodiment of a current reference circuit in accordance with the present invention.

Referring now to FIG. 2, the current reference circuit in accordance with the invention has no resistor. The source of the second transistor 13 of the second current mirror is connected to the negative supply terminal 2 via a diode-connected n FET 33 and the source of the first n FET 12 is connected to the negative supply rail 2 via the series connection of the source/drain path of a p FET 30 and diode-connected n FET 31. The diode-connected n FET 31 is connected to the negative supply terminal 2 and the control p FET 30 has its gate connected to the negative supply terminal 2. The first n FET 12 of the second current mirror is large by comparison with the second n FET 13 of the second current mirror.

In operation, the first current mirror 10,11 constrains the current in the first branch containing elements 10, 12, 30, 31, to be the same as the current through the second branch comprising elements 11, 13, 33. Current flow through the diode-connected in FET 31 is the first branch provides a gate-source potential between the gate 32 of the control p FET 30 and its source so that the control p FET 30 provides a drain-source resistance. The effect of the drain-source resistance is to unbalance the current mirrors and thus to reduce the current flow through the first (relatively large) transistor 12 of the second current mirror to the second (relatively small) transistor 13 of the second current mirror.

the first transistor 10 and the second transistor 11 of the first current mirror are further connected to the control electrode of an output p FET 24 whose source is connected to the positive supply terminal 1.

What is claimed is:

1. An integrated current reference circuit comprising a first current mirror and a second current mirror, the first current mirror having a first diode-connected transistor providing a controlling input and a first controlled transistor having a control electrode connected to a control electrode of the first diode-connected transistor, and the second current mirror having a second diode-connected transistor providing a controlling input and a second controlled transistor having a control electrode connected to a control electrode of the second diode-connected transistor, the first diode-connected transistor and the second controlled transistor and the first controlled transistor and the second diode-connected transistor respectively forming first and second serial branches disposed between a first supply rail and a second supply rail, wherein one of said branches comprises a series connection of a voltage offset circuit and a control transistor having a main current path, the voltage offset circuit being connected between the main current path of the control transistor and one of said supply rails, and a control terminal of the control transistor being coupled to said one supply rail, wherein the first current mirror includes transistors having a first polarity and the second current mirror includes transistors having a second polarity that is opposite the first polarity;

wherein the second diode-connected transistor is large by comparison with the second controlled transistor.

2. The circuit of claim 1 wherein the first current mirror comprises p MOSFETs and the second current mirror comprises n MOSFETs.

3. The circuit of claim 1 wherein the control transistor is a p MOSFET, and wherein said one supply rail is a negative supply rail.

4. The circuit of claim 1 wherein the voltage offset circuit comprises a diode.

5. The circuit of claim 4 wherein said diode comprises a diode-connected FET.

6. The circuit of claim 1 wherein the other of said branches comprises a voltage offset circuit.

7. The circuit of claim 1 further comprising an output transistor having a control electrode connected to the control electrode of the first diode-connected transistor of the first current mirror.

8. The circuit of claim 7 wherein the first current mirror comprises p MOSFETs and the second current mirror comprises n MOSFETs.

9. The circuit of claim 7 wherein the control transistor is a p MOSFET, and wherein said one supply rail is a negative supply rail.

10. The circuit of claim 7 wherein the voltage offset circuit comprises a diode.

11. The circuit of claim 10 wherein said diode comprises a diode-connected FET.

* * * * *